US005609430A

United States Patent [19]

Mazzola et al.

[11] Patent Number: 5,609,430

[45] Date of Patent: Mar. 11, 1997

[54] DISPENSING DEVICE FOR SEMI-SOLID PRODUCTS

[75] Inventors: Bernard V. Mazzola, Ramsey; Gary Montalbano, Hazlet, both of N.J.

[73] Assignee: Avon Products, Inc., New York, N.Y.

[21] Appl. No.: 362,207

[22] Filed: Dec. 22, 1994

[51] Int. Cl.[6] ..... A45D 40/00; A45D 40/12

[52] U.S. Cl. ..... 401/87; 401/68; 401/75; 401/78; 401/88

[58] Field of Search ..... 401/87, 88, 98, 401/78, 68, 75

[56] References Cited

U.S. PATENT DOCUMENTS

| | | | |
|---|---|---|---|
| D. 152,876 | 3/1949 | Franklin | D86/10 |
| D. 176,363 | 12/1955 | Manville | D86/10 |
| D. 176,364 | 12/1955 | Manville | D86/10 |
| D. 176,372 | 12/1955 | Noyack | D86/10 |
| D. 176,394 | 12/1955 | Wolff | D86/10 |
| D. 176,395 | 12/1955 | Wolff | D86/10 |
| D. 177,787 | 5/1956 | Wolff | D86/10 |
| D. 275,040 | 8/1984 | Holloway | D28/76 |
| D. 290,762 | 7/1987 | Holloway | D28/89 |
| 2,309,000 | 1/1943 | Morrison | 206/56 |
| 2,350,640 | 6/1944 | Rorke | 206/56 |
| 2,521,140 | 9/1950 | Abbotts | 206/56 |
| 2,521,169 | 9/1950 | Houlihan | 206/56 |
| 2,753,991 | 7/1956 | Sherman | 206/56 |
| 2,798,599 | 7/1957 | Croce | 401/87 X |
| 2,815,123 | 12/1957 | Safianoff | 401/87 |
| 3,124,245 | 3/1964 | Hopgood | 206/56 |
| 3,310,168 | 3/1967 | Landen . | |
| 3,332,429 | 7/1967 | Bates | 132/79 |
| 3,333,740 | 8/1967 | Waller | 222/182 |
| 4,208,144 | 6/1980 | Idec | 401/192 |
| 4,380,402 | 4/1983 | Andrews | 401/74 |
| 4,820,070 | 4/1989 | Spatz | 401/87 |
| 4,983,059 | 1/1991 | Holloway | 401/78 |

FOREIGN PATENT DOCUMENTS

| | | | |
|---|---|---|---|
| 2426427 | 12/1979 | France . | |
| 2438986 | 5/1980 | France . | |
| 2698528 | 6/1994 | France | 401/87 |
| 3442094 | 5/1986 | Germany . | |
| 8712670 | 1/1988 | Germany . | |
| 511243 | 6/1955 | Italy | 401/98 |
| 7500779 | 7/1975 | Netherlands | 401/68 |
| 2169045 | 8/1988 | United Kingdom . | |
| 2194774 | 4/1990 | United Kingdom . | |
| 9212651 | 8/1992 | WIPO | 401/87 |

*Primary Examiner*—Steven A. Bratlie

*Attorney, Agent, or Firm*—Ohlandt, Greeley, Ruggiero & Perle

[57] ABSTRACT

There is provided a device for dispensing a semi-solid or highly viscous product, such as a cosmetic product or pomade, which tends to vaporize and shrink with the passage of time. The device includes a support member to prevent the product from moving axially, radially or otherwise undesirably within the support member. The inner wall of the support member includes a plurality of radially curved and inwardly extending ribs that support the product therein without fracturing the product when it is inserted into the support member. The ribs support the product to prevent the product from moving axially and orbitally with respect to the support member.

15 Claims, 2 Drawing Sheets

DISPENSING DEVICE FOR SEMI-SOLID PRODUCTS

BACKGROUND OF THE INVENTION

1. Field of the Invention

This invention relates to devices for dispensing products. More particularly, the invention relates to dispensing devices for products, such as cosmetic sticks, that may shrink or otherwise change size with age and/or use.

Semi-solid or highly viscous products, such as pomade of lipstick or lipbalm, are typically dispensed from small, lightweight dispensing devices that are convenient for transporting and handling. Such dispensing devices have a support member, such as a godet, that axially and radially supports the product within the device. To incorporate the semi-solid product within the dispensing device during manufacture, the product is typically preformed and then inserted into the godet. Thus, during this manufacturing process, the product is firmly positioned axially and rotationally in the support member.

One problem with semi-solid products, particularly cosmetic products, is that the pomade may become loose within the support member over time. The volume of the pomade is volatile due to its partially aqueous composition. Typically, a pomade such as lipstick has a composition that is 48% to 52% liquid. Thus, the pomade vaporizes and shrinks with the passage of time due to its unique composition and, as a result, the outer surface of the pomade pulls away from the inner wall of the godet. Accordingly, shrinkage will result in insufficient support for the pomade and, thereby, prevent it from shilling axially and radially with the godet.

2. Description of the Prior Art

Devices for dispensing semi-solid, and substantially solid, products are known. Such products include, but are not limited to, lipstick or other such applicators. For use, a body portion of the dispenser is actuated to expose the product at one end of the device. When the product is not in use, it is retracted back into the device for storage and future use.

Typically, such dispensing devices have a support member or a godet for accommodating the semi-solid product within the dispensing device. For example, U.S. Pat. No. 3,333,740 to C. D. Waller, which issued on Aug. 1, 1967, titled SCREW ACTUATED DISPENSER, provides a dispenser having a cup-like follower for supporting a semi-solid product. Extending from the base of the follower are headed post elements that anchor the substance to the follower. By rotating a body portion of the dispenser, the follower is rotated and the product is projected from one end of the dispenser.

Improvements have been made to such dispensing devices to reduce the tendency of the semi-solid product to shake within the support member. It has been found that ribs on the inner surface of the support member enhance the frictional engagement to the semi-solid product. For example, U.S. Pat. No. 3,124,245 to R. B. Hopgood, which issued on Mar. 10, 1964, titled LIPSTICK CONTAINER, provides a cosmetic container support cup that has ribs which are integral to the inner surface of the cup to grip the inserted product. Also, U.S. Pat. No. 4,208,144 to E. J. Idec, et al., which issued on Jun. 17, 1980, titled COSMETIC APPLICATOR WITH TRANSPARENT CONTAINER PORTION, provides a support cup having ribs on its inner surface to enhance and directionally stabilize retention of the inserted product.

Other patents that utilize ribs on the inner surface of a support member include United Kingdom Patent No. 2,194,774; German Patent No. DE 034 42 094 A1; German Patent No. DE 87 12 670 U1; French Patent No. 2,426,427; and French Patent No. 2,438,986.

However, such dispensing devices still suffer from the problem that the semi-solid products shrink with the passage of time and, thus, pull away in a radial direction from the inner wall of the support member. These dispensing devices are not designed to accommodate such shrinkage and appear to be of a configuration that emphasizes initially securing the pomade in the godet, without regard to subsequent shrinkage. Accordingly, it has been found that the ribs located on the inner wall of the support members of the prior art are not effective to support a product that has a radially contracted outer surface due to shrinkage.

U.S. Pat. No. 4,820,070 to W. Spatz titled DISPENSING DEVICE FOR COSMETIC STICKS AND THE LIKE, provides a support cup of a dispensing device having ribs on the inner wall surface of the cup. Each rib has a dove-tail cross-section to support a semi-solid product even as the product shrinks over a period of time. Each rib has an inner surface that is projected radially inward toward the semi-solid product. The inner surface of the rib has a length that is greater than the length of either of its side surfaces that are connected to to the inner surface of the cup. However, it has been found that this support structure pierces the pomade during production such as to fracture or otherwise damage it.

Thus, heretofore, there has been a need for an improved dispensing device support member or godet that provides even better axial and radial support for a semi-solid product that shrinks with the passage of time, yet avoids fracturing the pomade and otherwise minimizes damage to the pomade.

SUMMARY OF THE INVENTION

It is an object of the present invention to provide an improved dispenser for semi-solid or highly viscous products, such as cosmetics products, in which the product is firmly secured in the dispenser despite shrinkage of the product and/or adverse forces and conditions.

It is another object of the present invention to provide an improved support member of such a dispensing device in which the support member sufficiently supports the product to prevent the product from becoming loose, yet does not fracture or damage, and minimizes lancing of the product when it is inserted into the support member.

It is still another object of the present invention to provide such a support member having plurality of ribs formed on its inner wall that stabilize the position of the product within the support member despite changes in the size or circumference of the product.

It is yet another object of the present invention to provides such a plurality of ribs in which each rib is situated at an angled or curved position away from the middle portion of the support member to minimize axial forces that would fracture or otherwise damage the pomade.

It is a further object of the present invention to provide such a plurality of ribs wherein each rib has a curvature to further stabilize the position of the product in both the axial and radial directions.

These and other objects of the present invention are provided by a device for dispensing a semi-solid product that has a tendency to shrink radially with time. The device includes a support member for contacting an outer surface of the product and for supporting the product within the device. The support member comprises a hollow member having an inner wall. The hollow member has a center axis passing therethrough that is, preferably, equidistant from all locations on the inner wall. In addition, the hollow member is adapted to receive the semi-solid product, wherein the outer surface of the product is flush against the inner wall of the hollow member when initially inserted therein. The support member further comprises a plurality of circumferentially spaced ribs disposed axially within the hollow member. At least one of the plurality of ribs extends non-radially inward from the inner wall of the hollow member to support the product both orbitally about the center axis and centripetally toward the center axis.

The support member of the device of the present invention also includes at least one rib of a plurality of ribs that extends curvilinearly inward from the inner wall of the hollow member to support the product both orbitally about the center axis and centripetally toward the center axis.

The above, and other objects, features and advantages of the present invention will become apparent from the following description read in conjunction with the accompanying drawings, in which like reference numerals designate the same elements.

BRIEF DESCRIPTION OF THE DRAWINGS

The foregoing and still other objects and advantages of the present invention will be more apparent from the following detailed explanation of the preferred embodiments of the invention in connection with the accompanying drawings wherein.

DETAILED DESCRIPTION OF THE PREFERRED EMBODIMENT

Figure 1:
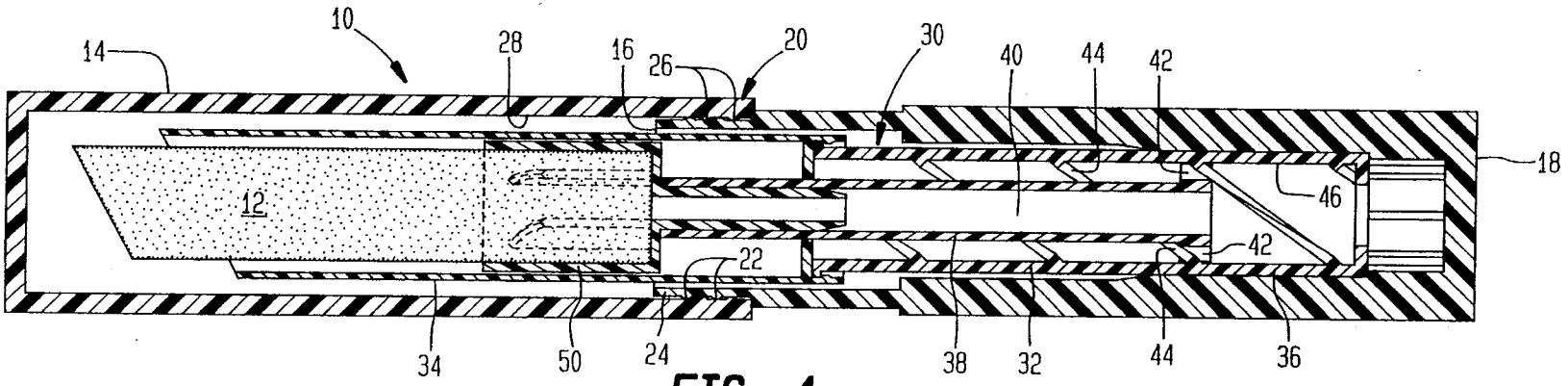
FIG. 1 is a cut-away view of a dispensing device that includes the support member of the present invention.

Referring to the figures and, in particular, FIG. 1, there is shown a preferred embodiment of the device for dispensing semi-solid or highly viscous products of the present invention, the dispensing device generally represented by reference numeral 10. In the preferred embodiment, the device 10 is a cosmetic device for dispensing, retracting, applying and storing a semi-solid cosmetic product 12, such as a pomade or lipstick. The device 10 is small and lightweight and is designed to be held in one hand for convenient use. However, it is to be understood that the preferred embodiment as shown in FIG. 1 and described herein is provided for illustrative purposes only. The present invention may be used with any type of dispensing device known in the art and is not limited to dispensing devices for cosmetic products.

Referring to FIG. 1, the outer housing of the device is generally cylindrical and comprises a cap 14 removably attached to the open end 16 of a barrel 18 by a snap arrangement 20. The snap arrangement 20, preferably, includes a pair of molded rings 22 that are formed at the outer periphery 24 of the barrel 18 and a corresponding pair of peripheral notches 26 formed at the inner periphery 28 of the cap 14. The dimensions of the molded rings 22 and peripheral notches 26 of the snap arrangement 20 are such that the cap 14 is frictionally held on the barrel 18, but is removable so that the device 10 can be used.

The inner compartment 30 of the device 10 includes a guide section 32 and an upper section 34. The guide section 32 is supported at its lower portion 36 by the barrel 18 so that the guide section 32 and barrel 18 rotate together. The upper section 34 is positioned adjacent to the guide section 32 in a non-engaging manner to rotate in the direction opposite the rotational direction of the guide section. In other words, the guide section 32 and the upper section 34 are situated to rotate in opposite directions relative to each other.

The inner compartment 30 further includes a support member or godet 50 and member driver 38 situated within the guide section 32 and the upper section 34. In contrast, and relative, to the rotational directions of the guide section 32 and the upper section 34, the support member 50 and member driver 38 move together in an axial direction. A small hollow section 58 (shown in FIG. 2) at one end of the support member 50 is held within an inner bore 40 of the member driver 38 so that the support member and member driver effectively move as one unit. The member driver has a set of guide followers 42 are formed at its lower end. The guide followers 42 travel between dual guides 44 that are formed on the inner surface 46 of the guide section 32. The semi-solid product or pomade 12 is dispensed from the preferred device 10 by gripping the barrel 18 and upper section 34 separately and rotating them in opposite rotational directions.

Figure 2:
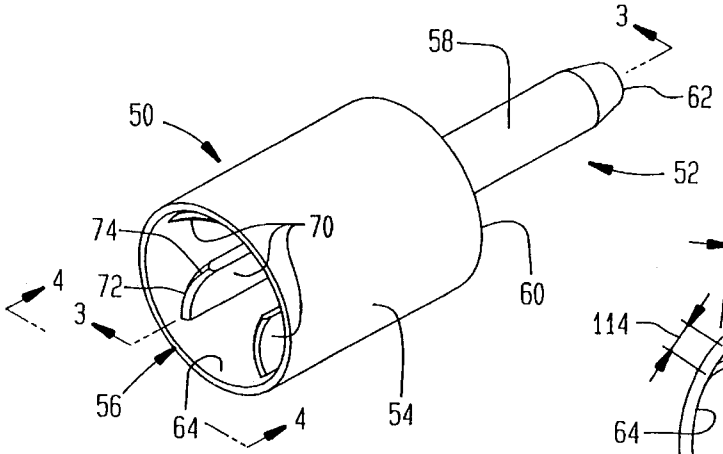
FIG. 2 is a perspective view of the support member of FIG. 1.

Referring to FIG. 2, there is shown a perspective view of the support member 50 as removed from the dispensing device of the preferred embodiment. The support member 50 includes a large hollow section 54 having a front open end 56 that is attached to the small hollow section 58. The distal end 62 of the small hollow section 58 is tapered to facilitate its insertion into the inner bore 40 of the member driver 38, (shown in FIG. 1) as described above.

On the inner walls 64 of the large hollow section 54, there are formed arcuate ribs 70. These arcuate ribs 70 have a curved body with a radius of curvature discussed later herein and an arcuate edge 74. Three ribs 70 are partially shown in FIG. 2. The front portion 72 of each rib 70 is curved or tapered to form an edge 74 to reduce the amount of force required to insert the semi-solid product or pomade 12 into the large hollow section 54. In addition, the edge 74 of each rib 70 is angled or curved back toward the back end 60 of the large hollow section 54 to further ease the insertion force of a semi-solid product or pomade 12.

Another benefit of the tapered, angled and curved form of the ribs' edges 74 is to prevent fracturing or similar damage to the pomade 12 as the rib 70 lances it. The edge 74 makes a fine etch or lance in the pomade 12 but does not cause the pomade to break or fracture.

Figure 3:
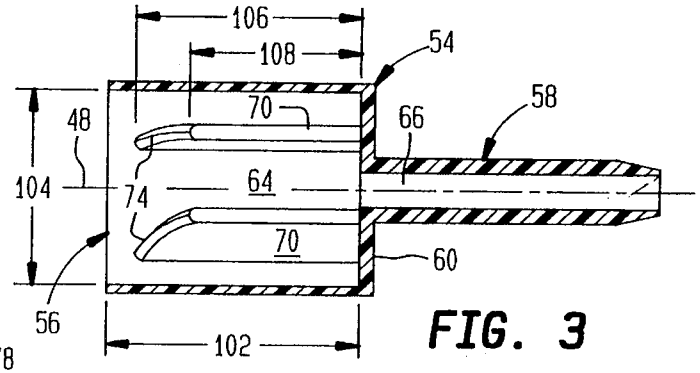
FIG. 3 is cut-away view of the support member taken through lines 3—3 of FIG. 2.

Referring to FIG. 3, two of the plurality of ribs 70 are more clearly shown. As described above, each rib 70 has a front edge 74 that angles or curves back as it extends inward and away from the inner wall 64 of the large hollow section 54. Where a preformed semi-solid product or pomade 12

(not shown in FIG. 3) is inserted into the large hollow section 54 through its front open end 56, each rib 70 lances into the product without fracturing the same to provide a secure hold. Also, the back end 60 of the large hollow section 54 has a small opening 66 to relieve air pressure as the pomade is inserted.

Generally, the dimensions of the internal compartment of the large hollow section 54 is dependent upon the dimensions of the semi-solid product or pomade 12 to be place therein. For the preferred support member or godet 50, the height 102 of the internal compartment is about 0.405 inches±0.005 inches and the diameter 104 of the front open end 56 is about 0.328 inches±0.001 inches. Also, it is preferred that the height 106 of the ribs 70 along the inner wall 64 of the large hollow surface 54 be about 0.370 inches±0.005 inches, and the height 108 of the ribs along its inner boundary be about 0.100 inches±0.005 inches.

Figure 4:
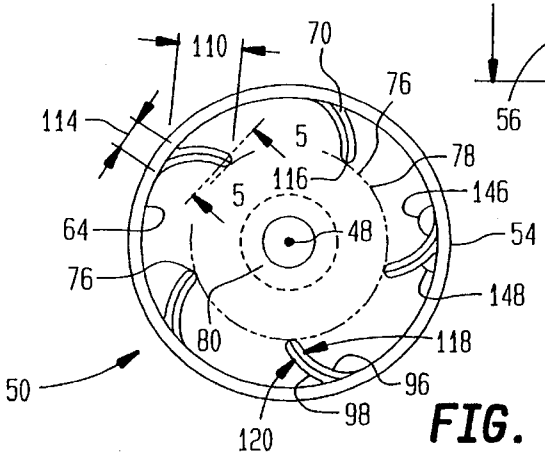
FIG. 4 is a side view of the support member taken through lines 4—4 of FIG. 2.

Referring to FIG. 4, the ribs 70 extends non-radially inward from the inner wall 64 of the large hollow member 54 to support the product both orbitally about the center axis 48 and centripetally toward the center axis. The ribs 70 of the support member or godet 50 are situated in a orbital formation around the inner wall 64 and, thus, are disposed in an axial direction, i.e., parallel with center axis 48, within the godet. The ribs 70 extend orbitally inward from the inner wall 64 of the godet 50 to an inner boundary 76 that is a predetermined distance or inward length 110 from the inner wall. Although the number of ribs 70 situated within the godet 50 may vary, it is preferred that five orbitally spaced ribs be disposed axially within the support member. It has been determined that four ribs 70 do not provide adequate retention of the pomade 12 (shown in FIG. 1) within the godet 50 and six ribs pierces the pomade excessively, thereby fracturing and damage to the pomade. Also, it is preferred that the ribs 70 be evenly spaced along the inner wall 64 of the godet 50.

The ribs 70 of the godet 50 have a predetermined distance or inward length 110 extending from the inner wall 64 of the large hollow section 54 to an inner boundary 76 of the rib and a peripheral length or thickness 114 along the junction of the rib and the inner wall. By creating a rib 70 that has an inward length 110 that is greater than its peripheral length 114, the rib prevents fracturing of the pomade 12 when inserting the product into the godet 50.

Each rib 70 is angled away from the middle portion 80 of the large hollow section 54 to support the pomade 12 within the support member or godet 50 in two directions: a first centripetal direction towards the center of the large hollow section, and a second orbital direction about a center axis 48 passing through the large hollow member 54. By angling the ribs 70 from the inner wall 64, the ribs further aid the godet 50 to hold the pomade 12 in place. It has also been determined that slightly curving each rib back towards the middle portion 80 of the large hollow section 54 further enhances the ability of the ribs 70 to secure the pomade 12 within the godet 50. In other words, the ribs 70 extend curvilinearly inward from the inner wall 64 to support the product both orbitally about the center axis 48 and centripetally toward the center axis.

For the preferred embodiment, the dimensions of the ribs are as follows. The inward length 110 from the inner wall 64 of the godet 50 to the inner boundary 76 is about 0.054 inches±0.005 inches and the diameter of the inner boundary is about 0.220 inches±0.005 inches. As stated above, the peripheral length or thickness 114 along the junction of the rib 70 and the inner wall 64 is less than the inward length 110 and, thus, the peripheral length is about 0.025 inches±0.005 inches. Also, the radius of curvature 116 at the portion of each rib 70 that intersects the inner boundary 76 is about 0.010 inches±0.005 inches.

Each rib 70 has a inner side surface 96, and an outer side surface 98 located on the opposite side of the rib that has a greater radius of curvature than the inner side surface. The inner side surface 96 forms an inner obtuse angle 146 with the inner wall 64 of the rib 70 and the outer side surface 98 forms an outer acute angle 148 on the opposite side. The angle of the outer acute angle 148 is preferably from about 15 degrees to about 60 degrees and, more preferably, about 36 degrees. In addition, the radius of curvature 118 of the inner side surface 96 ranges from about 0.030 inches to about 0.125 inches and, similarly, the radius of curvature 120 of the outer side surface 98 also ranges from about 0.030 inches to about 0.125 inches. Preferably, the radius of curvature 118 of the inner side surface 96 is about 0.075 inches±0.005 inches, and the radius of curvature 120 of the outer side surface 98 is about 0.095 inches±0.005 inches.

It has been determined by various lab tests that the preferred embodiment provides excellent retention of the product within the godet of the dispenser. Such testing included dropping the device of the preferred embodiment from a height of 6 inches. In another test, several of the components of the preferred embodiment were uncovered and placed in a 110° F. box for up to three weeks to determine how well the supporting device holds the product as shrinkage occurs. Even after such rigorous testing, the pomade remained firmly in place in the godet of the preferred embodiment, even after holding the device with the product directed downward and applying slight finger pressure to the product. The slight pressure applied was comparable to the average pressure experienced such products during normal use which is about 0.3 ounces per square inch.

Figure 5:
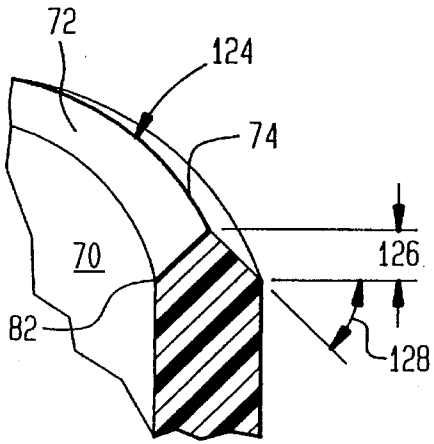
FIG. 5 is a partial cut-away view of a single rib taken through lines 5—5 of FIG. 4.

Referring to FIG. 5, the front portion 72 of each ribs 70 is tapered inward to form a front edge 74, as described above. This front edge 74 of each rib 70 pierces into the pomade 12 (not shown in FIG. 5) as it is inserted into the large hollow section 54 without fracturing or otherwise damaging the product. Although an absolutely sharp edge would be ideal for the front edge 74 of each rib 70, a substantially tapered edge has been found to be sufficient to serve the above purposes and advantages of the present invention.

For the preferred embodiment, the front edge 74 has a radius of curvature 124 of about 0.125 inches±0.005 inches, and the height 126 of the front edge 74 from the base 82 of the front portion 72 is about 0.005 inches±0.005 inches. It is also preferred that the angle 128 of each of the two sides of the front portion 72 be about 45.0° relative to the base 82 of the front portion.

Figure 7:
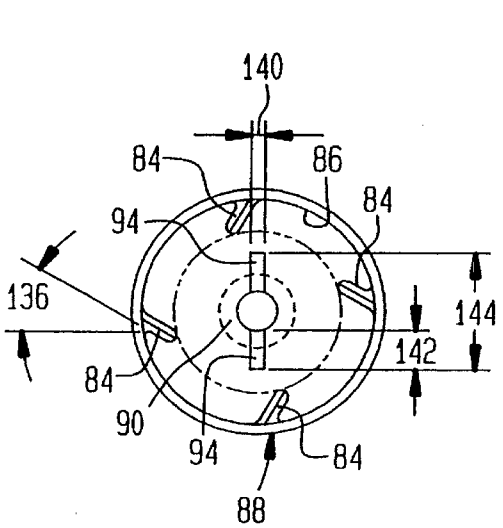
FIG. 7 is a side view of the alternative support member shown in FIG. 6.
Figure 6:
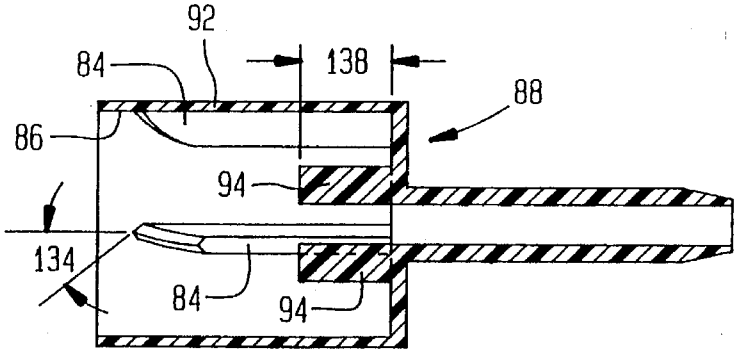
FIG. 6 is a cut-away view of an alternative embodiment of the support member of the present invention.

An alternative embodiment of the device 10 of the present invention is shown in FIGS. 6 and 7. The number of ribs 84 formed on the inner wall 86 of the support member 88 has been reduced to four due to the addition of middle ribs 94 in the middle portion 90, described below. The length and angle of each rib is such that the rib 84 will be effective to prevent axial and rotational movement of the pomade 12 within the support member 88.

However, the four ribs 84 alone do not provide adequate retention of the pomade 12 within the support member 88, and the shorter length of the rib, relative to the preferred embodiment further reduces the ribs retention abilities. To compensate for this reduction of retention, at least one rib 94 is formed at the middle portion 90 of the large hollow section 92. Two such middle ribs 94 are shown in FIGS. 6 and 7. Although these additional middle ribs 94 provide good retention of the pomade 12 in the support member 88, it has been determined that such ribs create the possibility of fracturing or otherwise damaging the product as it is inserted into the support member.

Due to the non-curved nature of the ribs 84 of the alternative embodiment, the ribs may be further specified by an axial angle of positioning and a radial angle of positioning. Preferably, the axial angle of positioning 134 of the ribs is about 45.0° and the radial angle of positioning 136 of the ribs is about 30.0°, as shown in FIGS. 6 and 7. Also, the preferred height 138 of the middle ribs 94 is about 0.125 inches±0.005 inches, the preferred width 140 of the middle ribs is about 0.020 inches±0.005 inches, and the preferred length 142 of the middle ribs is about 0.018 inches±0.005 inches. In addition, in a situation where two middle ribs 94 are situated in the middle portion 80 of the large hollow section 92, the preferred distance 144 between the distal ends of the middle ribs is about 0.125 inches±0.005 inches.

The material for the godet 50 of the present invention may be any type of firm elastomeric material suitable for the features described herein. The group of suitable materials includes polypropylene, polyethylene, acetal, selcon and SAN. The preferred material is acetal.

The invention having been thus described with particular reference to the preferred forms thereof, it will be obvious that various changes and modifications may be made therein without departing from the spirit and scope of the invention as defined in the appended claims.

Wherefore, we claim:

1. A device for dispensing a semi-solid product that has a tendency to shrink radially with time, said device includes a support member for gripping an outer surface of the product and for supporting the product within said device, said support member comprising:

a hollow member having an inner wall, said hollow member having a center axis passing therethrough that is equidistant from all locations on said inner wall;

said hollow member being adapted to receive the semi-solid product, wherein the outer surface of the product is flush against said inner wall of said hollow member when initially inserted therein;

a plurality of circumferentially spaced ribs disposed axially within said hollow member; and at least one of said plurality of ribs extending non-radially inward from said inner wall of said hollow member to support the product both orbitally about said center axis and centripetally toward said center axis.

2. The device for dispensing the semi-solid product of claim 1, wherein said plurality of circumferentially spaced ribs extend non-radially inward from said inner wall of said hollow member.

3. The device for dispensing the semi-solid product of claim 1, wherein said at least one of said plurality of ribs is curved to support the product orbitally and centripetally within said hollow member.

4. The device for dispensing the semi-solid product of claim 1, wherein:

said at least one of said plurality of ribs has an inner side surface and an outer side surface; and said inner side surface forms an inner obtuse angle with said inner wall and said outer side surface forms an outer acute angle with said inner wall.

5. The device for dispensing the semi-solid product of claim 4, wherein said outer acute angle of said at least one of said plurality of ribs is from about 15 degrees to about 60 degrees.

6. The device for dispensing the semi-solid product of claim 1, wherein said plurality of circumferentially spaced ribs includes no more than five ribs, each rib being disposed axially within said support member.

7. The device for dispensing the semi-solid product of claim 1, wherein said hollow member includes at least one middle rib extending from a preset circumferential distance from said center axis to provide further support of said product within said support member.

8. A device for dispensing the semi-solid product of claim 1, wherein said at least one of said plurality of ribs has an inward length extending from said inner wall of said hollow member that is greater than a peripheral length along the junction of said rib and said inner wall to prevent fracturing of the product when inserting the product into said hollow member.

9. A device for dispensing a semi-solid product that has a tendency to shrink radially with time, said device includes a support member for gripping an outer surface of the product and for supporting the product within said device, said support member comprising:

a hollow member having an inner wall, said hollow member having a center axis passing therethrough that is equidistant from all locations on said inner wall;

said hollow member being adapted to receive the semi-solid product, wherein the outer surface of the product is flush against said inner wall of said hollow member when initially inserted therein;

a plurality of circumferentally spaced ribs disposed axially within said hollow member; and at least one of said plurality of ribs extending curvilinearly inward from said inner wall of said hollow member to support the product both orbitally about said center axis and centripetally toward said center axis.

10. The device for dispensing the semi-solid product of claim 9, wherein said plurality of circumferentially spaced ribs extend curvilinearly inward from said inner wall of said hollow member.

11. The device for dispensing the semi-solid product of claim 9, wherein said at least one of said plurality of ribs has an inner radius of curvature that is less than an outer radius of curvature.

12. The device for dispensing the semi-solid product of claim 9, wherein said at least one of said plurality of ribs has an inner radius of curvature of about 0.030 inches to about 0.125 inches.

13. The device for dispensing the semi-solid product of claim 11, wherein said inner radius of curvature of said at least one of said plurality of ribs is about 0.075 inches.

14. The device for dispensing the semi-solid product of claim 9, wherein said at least one of said plurality of ribs has an outer radius of curvature of about 0.030 inches to about 0.125 inches.

15. The device for dispensing the semi-solid product of claim 11, wherein said outer radius of curvature of said at least one of said plurality of ribs is about 0.095 inches.

* * * * *